US007620359B2

(12) United States Patent
Gardner et al.

(10) Patent No.: US 7,620,359 B2
(45) **Date of Patent: *Nov. 17, 2009**

(54) METHOD FOR PROCESSING A DUPLEXED DOCUMENT

(75) Inventors: William Everett Gardner, Louisville, KY (US); Scott Michael Heydinger, Lexington, KY (US); Khageshwar Thakur, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 922 days.

This patent is subject to a terminal disclaimer.

(21) Appl. No.: 11/133,524

(22) Filed: May 20, 2005

(65) Prior Publication Data

US 2006/0263125 A1 Nov. 23, 2006

(51) Int. Cl.
*G03G 15/00* (2006.01)

(52) U.S. Cl. ..... 399/364; 399/374

(58) Field of Classification Search ..... 358/401, 358/3.26; 399/364, 374
See application file for complete search history.

(56) References Cited

U.S. PATENT DOCUMENTS 5,646,744 A * 7/1997 Knox ..... 358/401
5,710,957 A 1/1998 Acquaviva
5,832,137 A * 11/1998 Knox ..... 382/275
5,973,792 A 10/1999 Matsuda
6,101,283 A * 8/2000 Knox ..... 382/254
6,185,012 B1 2/2001 Yun
6,215,492 B1 4/2001 Okuyama et al.
6,219,158 B1 4/2001 Dawe
6,288,798 B1 9/2001 Sharma
6,498,867 B1 12/2002 Potucek et al.
6,647,144 B2 11/2003 Williams et al.
6,667,756 B2 12/2003 Conrow et al.
6,707,583 B1 3/2004 Tsai et al.
6,753,984 B1 6/2004 Wada
6,806,896 B2 10/2004 Conrow et al.
6,862,117 B1 3/2005 Ford et al.
6,877,659 B2 4/2005 Abramsohn
2002/0071131 A1* 6/2002 Nishida ..... 358/1.9
2006/0263125 A1* 11/2006 Gardner et al. ..... 399/364
2006/0263126 A1* 11/2006 Heydinger et al. ..... 399/364
2007/0231031 A1* 10/2007 Heydinger et al. ..... 399/374

* cited by examiner

*Primary Examiner*—Twyler L Haskins
*Assistant Examiner*—David L Suazo
(74) *Attorney, Agent, or Firm*—Taylor & Aust

(57) ABSTRACT

A method for processing a duplexed document having a first side with a first image and a second side with a second image includes scanning only the first side of the document under a first imaging condition to retrieve first information relating to each of the first image and the second image; scanning only the first side of the document under a second imaging condition to retrieve second information relating to each of the first image and the second image; and determining from the first information and the second information a show-through contribution of the second image with respect to the first side of the duplexed document.

24 Claims, 4 Drawing Sheets

METHOD FOR PROCESSING A DUPLEXED DOCUMENT

BACKGROUND OF THE INVENTION

1. Field of the Invention

The present invention relates to a method for processing a duplexed document, and, more particularly, to a method for processing a duplexed document to determine a show-through contribution of a back-side image with respect to a front side of the duplexed document.

2. Description of the Related Art

Consumers may utilize a simple photocopying device to make copies of documents coming from a variety of sources which include a variety of mass print media, such as magazines and newspapers. Due to the large volume of these materials, magazine and newspaper producers typically print on low cost, low-grade thin paper stock. To further control costs, the media, e.g., paper, are typically printed in a duplex fashion, i.e., content is printed on both sides of the media, which will be referred to herein as a "duplexed document." As used herein, the term "front side" is used to refer to the side of the media that is facing the scanner of the photocopying device, and the "back side" is the side of the media opposite to the front side.

Due to the thinness of low-cost media, such media are not completely opaque. Therefore, in addition to sensing the intended document information from the front side of the duplexed document, the scanner sensor of the photocopying device may also sense document content that is printed on the back side of the duplexed document. The photocopy will therefore include both intended information, and unintended information commonly referred to as "show-through."

A known technique for detecting the show-through effect requires the user to scan both sides of the document. Once the pixel locations of undesirable show-through image information have been detected, methods of removal of the back-side show-through information from the front-side desired document can then be employed.

Such techniques have multiple drawbacks. For example, one drawback is that the duplexed document must be flipped over to face the scanner sensor, requiring either the use of complex and expensive duplexing hardware, or an undesirable user intervention to provide the necessary document flipping. As another example, such a technique typically requires a complicated algorithm to then spatially correlate the dual-side scanned information to account for both the horizontally flipped relationship between the two scans and the misalignment of the two images.

SUMMARY OF THE INVENTION

The present invention provides a method for processing a duplexed document to determine a show-through contribution of a back-side image with respect to a front side of the duplexed document using only single-side scanning of the duplexed document.

The invention, in one exemplary embodiment, is directed to a method for processing a duplexed document having a first side with a first image and a second side with a second image. The method includes scanning only the first side of the document under a first imaging condition to retrieve first information relating to each of the first image and the second image; scanning only the first side of the document under a second imaging condition to retrieve second information relating to each of the first image and the second image; and determining from the first information and the second information a show-through contribution of the second image with respect to the first side of the duplexed document.

The invention, in another exemplary embodiment, is directed to an imaging apparatus operable for processing a duplexed document having a first side with a first image and a second side with a second image. The imaging apparatus includes a scanner unit and a controller coupled to the scanner unit. The controller executes program instructions to scan with the scanner unit only the first side of the document under a first imaging condition to retrieve first information relating to the first image and the second image; scan with the scanner unit only the first side of the document under a second imaging condition to retrieve second information relating to the first image and the second image; and determine from the first information and the second information a show-through contribution of the second image with respect to the first side of the duplexed document.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
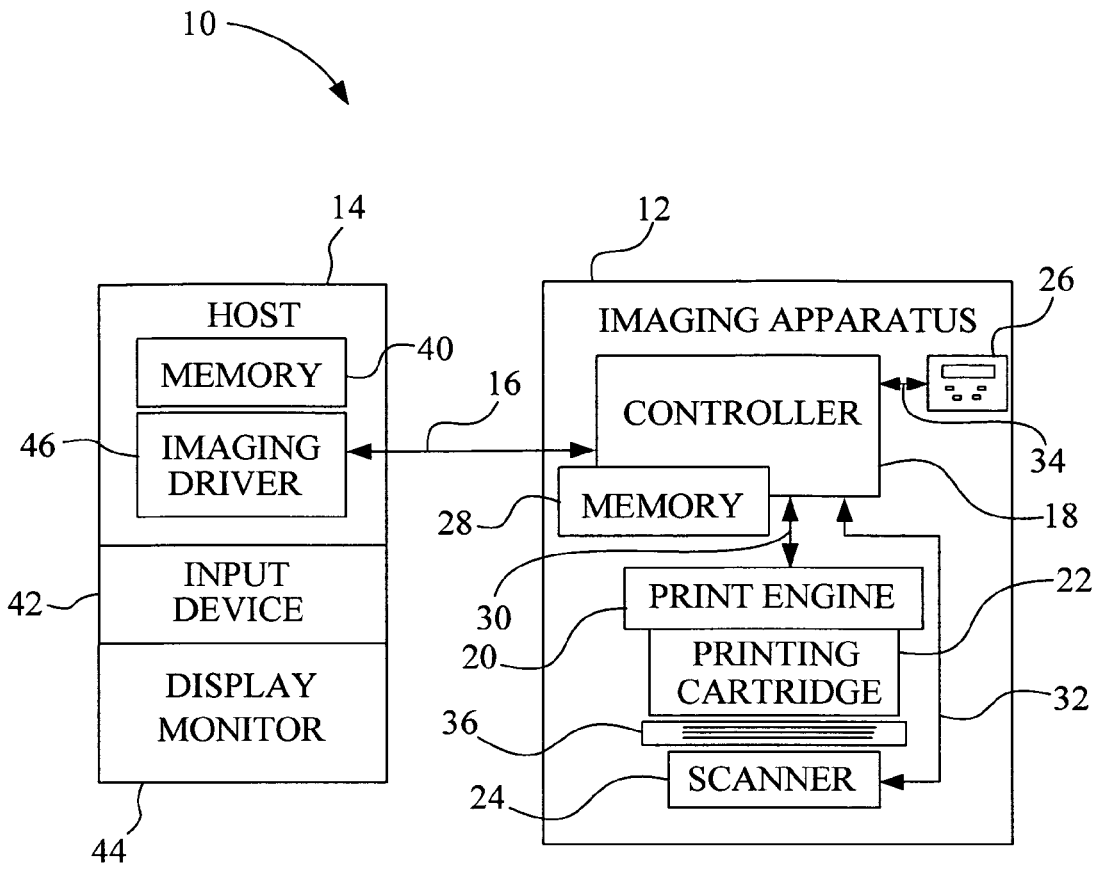
FIG. 1 is a diagrammatic depiction of an imaging system that utilizes the present invention.

Referring now to the drawings and particularly to FIG. 1, there is shown a diagrammatic depiction of an imaging system 10 embodying the present invention. Imaging system 10 includes an imaging apparatus 12 and a host 14. Imaging apparatus 12 communicates with host 14 via a communications link 16. As used herein, the term "communications link" is used to generally refer to structure that facilitates electronic communication between multiple components, and may operate using wired or wireless technology.

Imaging apparatus 12 may be, for example, an ink jet printer and/or copier, an electrophotographic printer and/or copier, a thermal transfer printer and/or copier, or an all-in-one (AIO) unit that includes a print engine, a scanner unit, and possibly a fax unit. An AIO unit is also known in the art as a multifunction machine. For example, as shown in FIG. 1, imaging apparatus 12 includes a controller 18, a print engine 20, a printing cartridge 22, a scanner unit 24, and a user interface 26. Imaging apparatus 12 may communicate with host 14 via a standard communication protocol, such as for example, universal serial bus (USB), Ethernet or IEEE 812.1x.

Controller 18 includes a processor unit and associated memory 28, and may be formed as one or more Application Specific Integrated Circuits (ASIC). Memory 28 may be, for example, random access memory (RAM), read only memory (ROM), and/or non-volatile RAM (NVRAM). Alternatively, memory 28 may be in the form of a separate electronic memory (e.g., RAM, ROM, and/or NVRAM), a hard drive, a CD or DVD drive, or any memory device convenient for use with controller 18. Controller 18 may be a printer controller, a scanner controller, or may be a combined printer and scanner controller. In the present embodiment, controller 18 communicates with print engine 20 via a communications link 30. Controller 18 communicates with scanner unit 24 via a communications link 32. User interface 26 is communicatively coupled to controller 18 via a communications link 34. Controller 18 serves to process print data and to operate print engine 20 during printing, as well as to operate scanner unit 24 and process image data obtained via scanner unit 24.

In the context of the examples for imaging apparatus 12 given above, print engine 20 can be, for example, an ink jet print engine, an electrophotographic print engine or a thermal transfer engine, configured for forming an image on a substrate 36, such as a sheet of paper, transparency or fabric. As an ink jet print engine, for example, print engine 20 operates printing cartridge 22 to eject ink droplets onto substrate 36 in order to reproduce text and/or images. As an electrophotographic print engine, for example, print engine 20 causes printing cartridge 22 to deposit toner onto substrate 36, which is then fused to substrate 36 by a fuser (not shown), in order to reproduce text and/or images.

Host 14, which may be optional, may be, for example, a personal computer, including memory 40, such as RAM, ROM, and/or NVRAM, an input device 42, such as a keyboard, and a display monitor 44. Host 14 further includes a processor, input/output (I/O) interfaces, and at least one mass data storage device, such as a hard drive, a CD-ROM and/or a DVD unit.

Host 14 includes in its memory a software program including program instructions that function as an imaging driver 46, e.g., printer/scanner driver software, for imaging apparatus 12. Imaging driver 46 is in communication with controller 18 of imaging apparatus 12 via communications link 16. Imaging driver 46 facilitates communication between imaging apparatus 12 and host 14, and may provide formatted print data to imaging apparatus 12, and more particularly, to print engine 20, to print an image.

In some circumstances, it may be desirable to operate imaging apparatus 12 in a standalone mode. In the standalone mode, imaging apparatus 12 is capable of functioning without host 14. Accordingly, all or a portion of imaging driver 46, or a similar driver, may be located in controller 18 of imaging apparatus 12 so as to accommodate printing during a copying or facsimile job being handled by imaging apparatus 12 when operating in the standalone mode.

Scanner unit 24 may be of a conventional scanner type, such as for example, a sheet feed or flat bed scanner. In the context of the present invention, in some embodiments either scanner type may be used. As is known in the art, a sheet feed scanner transports a document to be scanned past a stationary sensor device.

Figure 2:
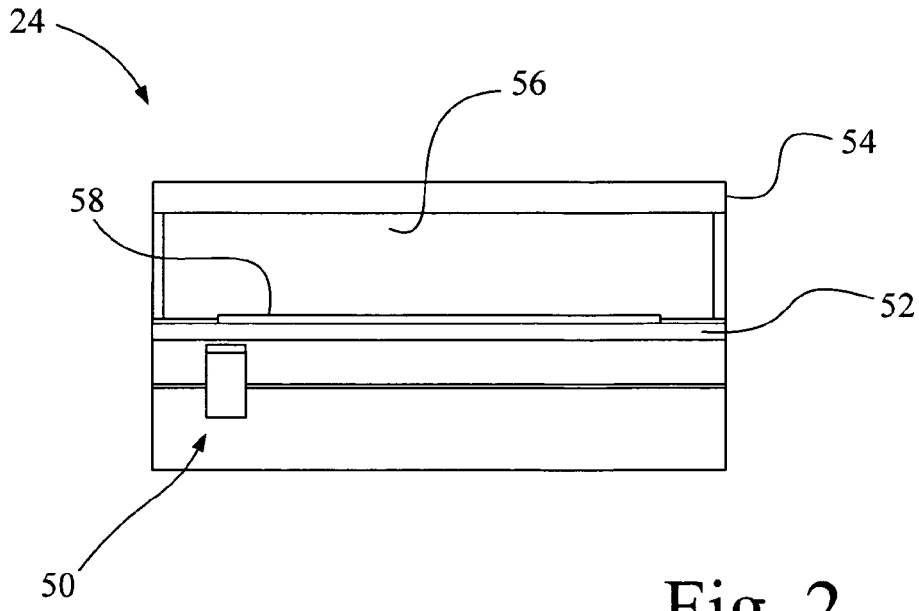
FIG. 2 is a diagrammatic representation of an embodiment of the scanner unit used in the imaging system of FIG. 1.

Referring to FIG. 2, there is shown an embodiment where scanner unit 24 is a flat bed scanner. Scanner unit 24 includes a scanning bar 50, a document glass 52 and a lid 54. FIG. 2 shows scanner unit 24 with lid 54 in an open position. Lid 54 includes a surface that forms a background 56 for a document 58 being scanned. During operation, lid 54 is lifted, document 58 to be scanned is placed on document glass 52, and in some embodiments, lid 54 is closed. Scanning bar 50, including one or more illuminants, e.g., lamps, LED arrays, etc., and including one or more sensor arrangements, then is scanned over the stationary document 58 to collect image data.

In one embodiment of the present invention, scanner unit 24 is controlled, such as by controller 18, to provide two different illumination levels. This may be achieved, for example, by adjusting the power supplied to the illuminant of scanning bar 50. Alternatively, this may be achieved, for example, by providing scanning bar 50 with two illuminants, each providing a different illumination level from the other.

In another embodiment of the present invention, scanner unit 24 is controlled, such as by controller 18, to provide two different spectral characteristics, e.g., light frequency ranges. This may be achieved, for example, by providing scanning bar 50 with two illuminants, each providing different spectral characteristics from the other.

In another embodiment of the present invention, scanning bar 50 of scanner unit 24 may include two sensor arrangements, each having different sensitivities in determining reflectivity from the other.

In another embodiment of the present invention, lid 54 may have reflectance characteristics that may be changed. For example, background 56 of lid 54 may be a surface that is highly reflective, e.g., a mirror surface or white surface, or background 56 of lid 54 may have a surface that has low reflectivity, e.g., is darkened or black. Such change in the reflectivity of background 56 may be achieved, for example, by providing background 56 as a rotatable belt having at least two different reflectance areas, or by the electronic manipulation of the background, as in the case of an electronic element array forming background 56.

The present invention detects locations of a scanned image corresponding to undesired show-through information, without having to scan both sides of the duplexed document. The present invention addresses the fact that different areas of a duplexed document may be affected differently by the show-through contribution of a back-side image. For example, consider two different pixels areas having different light intensities, yet measuring the same pixel value. One pixel value $g_1$ might result from scanning an image area with only information on the front side. Another area of the document may have a genuine shade of pixel value $g_2$ lighter than pixel value $g_1$, but still measure as pixel value $g_1$ instead of pixel value $g_2$ due to the presence of some image information on the back that has the effect of artificially darkening pixel value $g_2$.

Figure 3:
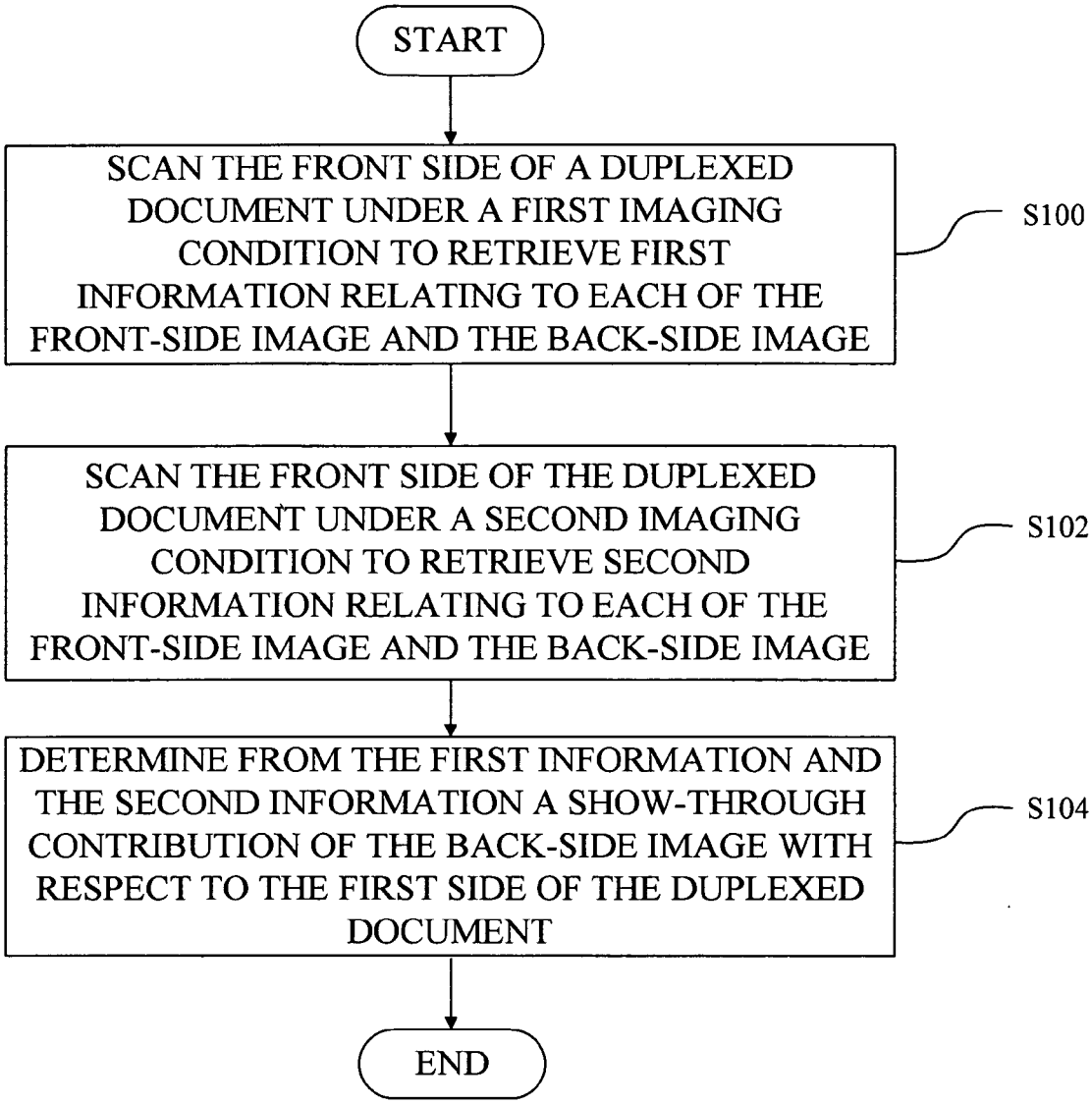
FIG. 3 is a flowchart of a method for processing a duplexed document to determine a show-through contribution of a back-side image with respect to a front side of the duplexed document using only single-side scanning of the duplexed document.

FIG. 3 is a flowchart of a method for processing a duplexed document to determine a show-through contribution of a back-side image with respect to a front side of the duplexed document using only single-side scanning of the duplexed document, and will now be described with further reference to FIGS. 4A-4C and 5. In summary, the present invention utilizes multiple scans of one side of a given duplexed document to generate dual scan data, and then compares the results to determine the likelihood of the presence of undesired information, i.e., a show-through contribution of the back-side image.

The method may be performed, for example, by imaging apparatus 12, such as an AIO unit, i.e., multifunction machine, either in a standalone mode or when operating in conjunction with host 14. As such, the steps of the flowchart of FIG. 3 may be performed by program instructions executed by controller 18 of imaging apparatus 12, or alternatively, by host 14 in conjunction with imaging apparatus 12.

In the method steps that follow, reference will be made to a first imaging condition and a second imaging condition. The following are examples of parameters that may be changed to achieve such first imaging condition and second imaging condition: illumination level, spectral characteristics, sensor sensitivities, backlighting levels, and lid background reflectance.

Also, for ease of understanding, referring to FIGS. 4A-4C, the method will be described with respect to a duplexed document 60 having a front side 62 and a back side 64. Printed on front side 62 is a front-side image 66, and printed on back side 64 is a back-side image 68.

At step S100, front side 62 of duplexed document 60 is scanned under a first imaging condition to retrieve first information relating to each of front-side image 66 and back-side image 68.

Figure 4A:
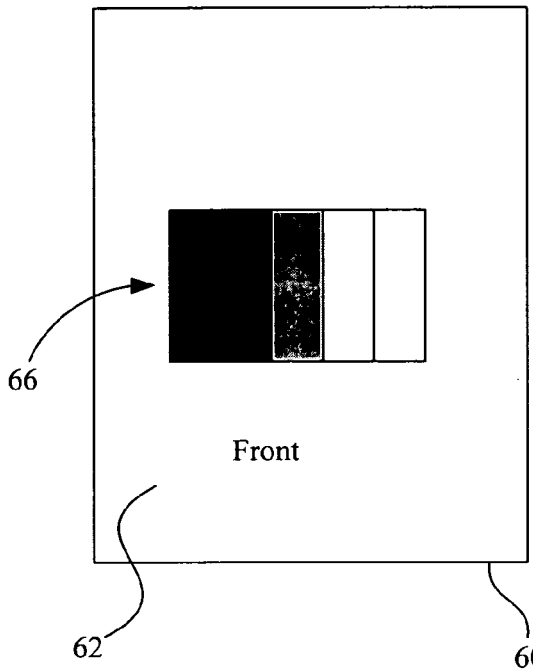
FIG. 4A shows a front-side image formed on a duplexed document.
Figure 4B:
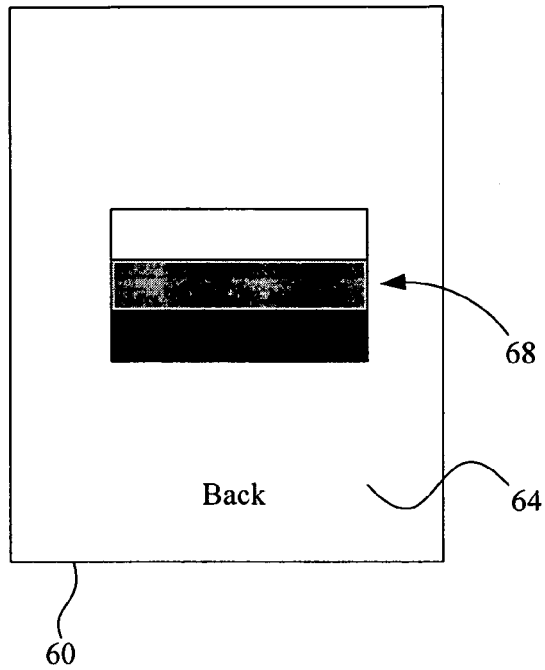
FIG. 4B shows a back-side image formed on the duplexed document of FIG. 4A.
Figure 4C:
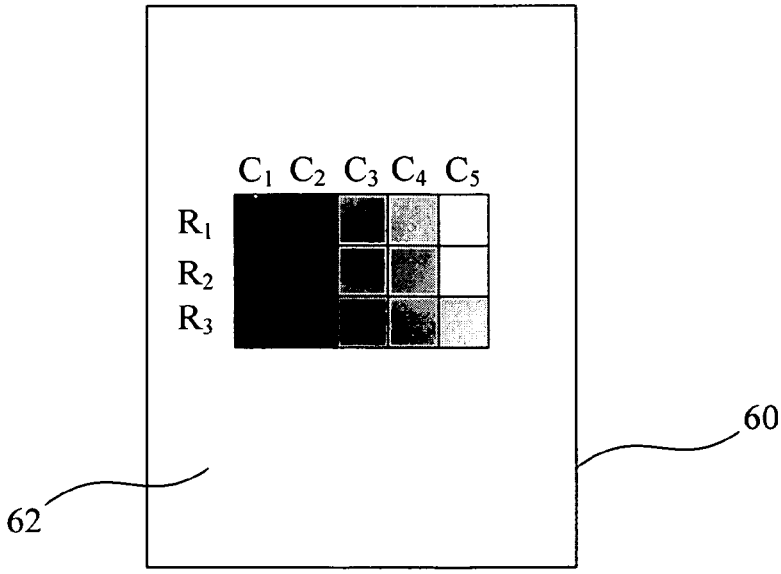
FIG. 4C illustrates, as viewed from the front side of the duplexed document, a show-through contribution of the back-side image of FIG. 4B to the front-side image of FIG. 4A of the duplexed document.

Referring to FIGS. 4A, 4B and 4C, front-side image 66 may be a first characterization pattern and back-side image 68 may be a second characterization pattern different from the first characterization pattern that is printed directly opposite to the first characterization pattern. The first characterization pattern of front-side image 66 has a plurality of regions and may be, for example, a plurality of parallel vertical bars, as shown in FIG. 4A, e.g., from left to right, black, dark gray, medium gray, light gray and white. The second characterization pattern of back-side image 68 has a plurality of regions and may be, for example, a plurality of parallel horizontal bars, as shown in FIG. 4B, e.g., from top to bottom, white, medium gray, and black.

FIG. 4C illustrates, as viewed from front side 62, a show-through contribution of the second characterization pattern formed on back side 64 that intersects the first characterization pattern of front-side image 66. In this example, the intersection results in a grid pattern. For ease of discussion, the rows of the grid pattern are labeled $R_1$, $R_2$, $R_3$, and the columns of the grid pattern are labeled $C_1$, $C_2$, $C_3$, $C_4$, $C_5$. Individual blocks will be referred to in the form of (Row, Column). Thus, the resulting show-through contribution of the horizontal bars of FIG. 4B on each of the vertical bars of FIG. 4A, is illustrated in FIG. 4C.

As shown in FIG. 4C, the vertical bars of front-side image 66 will be scanned as progressively darker from top to bottom due to the presence of darker bars from top to bottom on back-side image 68 of duplexed document 60. For example, as shown in FIG. 4C, in blocks $R_1$,$C_1$; $R_1$,$C_2$; $R_1$,$C_3$; $R_1$,$C_4$; and $R_1$,$C_5$, the white horizontal bar of back-side image 68 of FIG. 4B does not change the reflectivity of any of the vertical bars of front-side image 66, and as a result, along row $R_1$ the show-through contribution of back-side image 68 is negligible. In stark contrast, as shown in FIG. 4C, for example, in blocks $R_3$, $C_1$; $R_3$, $C_2$; $R_3$, $C_3$; $R_3$, $C_4$; and $R_3$, $C_5$, the black horizontal bar of back-side image 68 of FIG. 4B will change the reflectivity of (e.g., darken) the vertical bars of front-side image 66, particularly the light gray and white vertical bars, and as a result, the show-through contribution of back-side image 68 is significant along row $R_3$.

The "first information" relates to the reflectivity of the front-side image 66 and associated show-through contribution at each intersection of the show-through contribution of the plurality of horizontal bars of back-side image 68 with the plurality of vertical bars of front-side image 66.

Exemplary first information is shown in Table 1, below, as RGB reflectance data collected from a front-side scan of front side 62 of duplexed document 60. The entries in Table 1 correspond to the blocks in the grid of FIG. 4C under the first imaging condition, which in this example is with lid 54 of scanner unit 24 in the closed position.

TABLE 1

Collected RGB reflectance data of duplexed document 60 under the first imaging condition, e.g., conducting a front side scan and with scanner lid 54 closed.

| | Front-side image | | | | |
|---|---|---|---|---|---|
| Lid Closed Back-side image | Black ($C_1$) | dark gray ($C_2$) | mid-gray ($C_3$) | light gray ($C_4$) | white ($C_5$) |
| white (row $R_1$) | 24 | 57 | 111 | 185 | 255 |
| gray (row $R_2$) | 23 | 55 | 109 | 174 | 247 |
| black (row $R_3$) | 22 | 53 | 108 | 173 | 246 |

At step S102, front side 62 of duplexed document 60 is scanned under a second imaging condition to retrieve second information relating to each of front-side image 66 and back-side image 68. The second information relates to reflectivity of the front-side image 66 and associated show-through contribution at each intersection of the show-through contribution of the plurality of horizontal bars of back-side image 68 with the plurality of vertical bars of front-side image 66.

Exemplary second information is shown in Table 2, below, as RGB reflectance data collected from a second front-side scan of front side 62 of duplexed document 60. The entries in Table 2 correspond to the blocks in the grid of FIG. 4C under the second imaging condition, which in this example is with lid 54 of scanner unit 24 in the open position.

TABLE 2

Collected RGB reflectance data of duplexed document 60 under the second imaging condition, e.g., conducting a front side scan and with scanner lid 54 opened.

| | Front-side image | | | | |
|---|---|---|---|---|---|
| Lid Opened Back-side image | Black ($C_1$) | dark gray ($C_2$) | mid-gray ($C_3$) | light gray ($C_4$) | white ($C_5$) |
| white (row $R_1$) | 56 | 112 | 188 | 253 | 255 |
| gray (row $R_2$) | 43 | 89 | 147 | 222 | 255 |
| black (row $R_3$) | 20 | 68 | 120 | 186 | 252 |

At step S104, it is determined from the first information and the second information a show-through contribution of back-side image 68 with respect to front side 62 of duplexed document 60.

Figure 5:
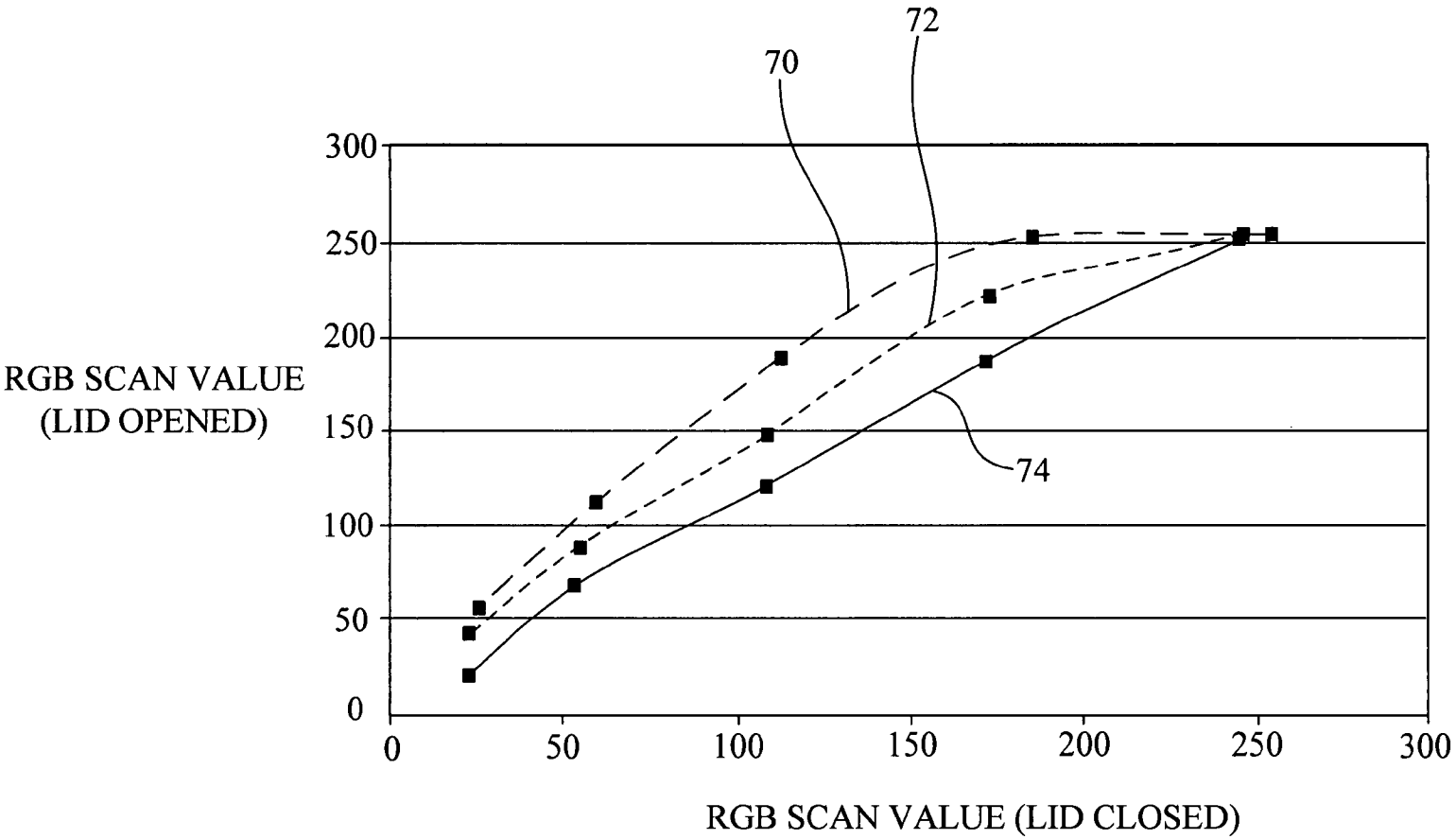
FIG. 5 is a graph that plots the collected RGB reflectance data of the duplexed document.

FIG. 5 is a graph that plots the collected RGB reflectance data of duplexed document 60 with a front-side scan and with scanner lid 54 closed (see Table 1) along the horizontal axis, versus the collected RGB reflectance data of duplexed document 60 with a front-side scan and with scanner lid 54 opened (see Table 2) along the vertical axis. Thus, the relationship between the two sets of data is exploited to provide useful discriminating information.

In FIG. 5, three curves are shown, each corresponding to a five block row, $R_1$, $R_2$, and $R_3$, respectively, shown in FIG. 4C, that includes the show-through contribution of back-side image 68 of FIG. 4B, e.g., the white, gray, and black horizontal bars. The curve corresponding to row R1, having a white back-side show-through pattern, is depicted by a widely spaced dashed line, and will be referred to as white curve 70. The curve corresponding to row R2, having a gray back-side show-through pattern, is depicted by a narrowly spaced dashed line, and will be referred to as gray curve 72. The curve corresponding to row R3, having a black back-side show-through pattern, is depicted by a solid line, and will be referred to as black curve 74.

Clearly, the white curve 70, gray curve 72 and black curve 74 are not coincident. Accordingly, the same side of an arbitrary document, e.g., document 58, can therefore be scanned under the two different illuminating conditions, and the resulting imaging information gray values used to determine the likelihood that the pixel is contaminated by show-through. For example, if the pair of scanned data for a given pixel plotted on the graph of FIG. 5 lies to the upper left of the white curve 70, the pixel is then judged to not be contaminated. However, if the pair of scanned data lies to the lower right of white curve 70, then image information contains some contamination. Furthermore, the precise location, in other words the relative proximity to gray curve 72 and/or black curve 74, relates to the relative degree of contamination.

Accordingly, the present invention may be used to remove the undesirable show-through contribution from the desired scanned information of a duplexed document to produce a more desirable scanned output.

In the example above, the two imaging conditions were based on the amount of backlighting, by having lid 54 of scanner unit 24 either closed or open. However, it is contemplated that the contrasting imaging conditions may be achieved by other techniques. For example, in one embodiment, the first imaging condition may include scanning at a first illumination level, and the second imaging condition may include scanning at a second illumination level different than the first illumination level. In another embodiment, the first imaging condition may include scanning with a first sensor having a first sensitivity, and the second imaging condition may include scanning with a second sensor having a second sensitivity different from the first sensitivity. In another embodiment, the first imaging condition may include scanning with a first illuminant having first spectral characteristics, and the second imaging condition may include scanning with a second illuminant having second spectral characteristics. In another embodiment, the second imaging condition may be varied from the first imaging condition by changing a reflectance characteristic of background 56 of scanner unit 24. In another embodiment, the second imaging condition may be varied from the first imaging condition by keeping lid 54 of scanner unit 24 open, while gating the illuminant ON and OFF at different regions of the document for each of the multiple scans. Also, combinations of the examples identified above may be used.

Those skilled in the art will recognize that the number of imaging conditions may be increased beyond two, if desired, to collect additional data for use in practicing the invention.

Accordingly, while this invention has been described with respect to embodiments of the invention, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method for processing a duplexed document having a first side with a first image and a second side with a second image, comprising:

scanning only said first side of said document under a first imaging condition to retrieve first information relating to each of said first image and said second image;

scanning only said first side of said document under a second imaging condition to retrieve second information relating to each of said first image and said second image; and determining from said first information and said second information a show-through contribution of said second image with respect to said first side of said duplexed document.

2. The method of claim 1, wherein said determining includes forming a characterization curve that relates said first information to said second information, wherein a position of said curve represents said show-through contribution of said second image with respect to said first side of said duplexed document.

3. The method of claim 2, further comprising:

scanning a second duplexed document to retrieve image data; and comparing said image data collected from said second duplexed document to said characterization curve to determine a show-through contribution associated with said second duplex document.

4. The method of claim 1, wherein said first image is a first characterization pattern and said second image is a second characterization pattern different from said first characterization pattern that is printed directly opposite to said first characterization pattern.

5. The method of claim 4, wherein each of said first characterization pattern and said second characterization pattern has a plurality of regions, said plurality of regions including at least a first region having a first reflectivity and a second region having a second reflectivity different from said first reflectivity.

6. The method of claim 4, wherein said second characterization pattern has a show-through contribution that intersects said first characterization pattern.

7. The method of claim 6, wherein said first characterization pattern has a first plurality of regions and said second characterization pattern has a second plurality of regions, and wherein each said first information and said second information relates to reflectivity of said first image and associated show-through contribution at each intersection of the show-through contribution of said second plurality of regions of said second image with said first plurality of regions of said first image.

8. The method of claim 7, wherein said second characterization pattern includes a white region forming a white show-through contribution for said first plurality of regions of said first image and at least one non-white region forming a corresponding at least one non-white show-through contribution for said first plurality of regions of said first image.

9. The method of claim 1, wherein said first imaging condition includes scanning at a first illumination level, and said second imaging condition includes scanning at a second illumination level different than said first illumination level.

10. The method of claim 1, wherein said first imaging condition includes scanning with a first sensor having a first sensitivity, and said second imaging condition includes scanning with a second sensor having a second sensitivity different from said first sensitivity.

11. The method of claim 1, wherein said first imaging condition includes scanning with a first illuminant having first spectral characteristics, and said second imaging condition includes scanning with a second illuminant having second spectral characteristics.

12. The method of claim 1, wherein said first imaging condition includes scanning with a first backlighting level, and said second imaging condition includes scanning with a second backlighting level.

13. The method of claim 12, wherein said first backlighting level is achieved with a lid of a scanner unit closed and wherein said second backlighting level is achieved with said lid of said scanner unit open.

14. The method of claim 1, further comprising positioning said duplexed document in a region between a document glass and a background, and wherein said second imaging condition is varied from said first imaging condition by changing a reflectance characteristic of said background.

15. The method of claim 1, wherein each of said first imaging condition and said second imaging condition is achieved with a lid of a scanner unit in an open position.

16. The method of claim 1, wherein said second imaging condition is varied from said first imaging condition by keeping a lid of a scanner unit open, while gating an illuminant of said scanner unit ON and OFF at different regions of said document for each said scanning of only said first side of said document.

17. An imaging apparatus operable for processing a duplexed document having a first side with a first image and a second side with a second image, comprising:

a scanner unit; and a controller coupled to said scanner unit, said controller executing program instructions to:

scan with said scanner unit only said first side of said document under a first imaging condition to retrieve first information relating to said first image and said second image;

scan with said scanner unit only said first side of said document under a second imaging condition to retrieve second information relating to said first image and said second image; and determine from said first information and said second information a show-through contribution of said second image with respect to said first side of said duplexed document.

18. The imaging apparatus of claim 17, wherein the determining of said show-through contribution includes forming a characterization curve that relates said first information to said second information, wherein a position of said curve represents said show-through contribution of said second image with respect to said first side of said duplexed document.

19. The imaging apparatus of claim 18, further comprising:

scanning a second duplexed document to retrieve image data; and comparing said image data collected from said second duplexed document to said characterization curve to determine a show-through contribution associated with said second duplex document.

20. The imaging apparatus of claim 17, wherein said first image is a first characterization pattern and said second image is a second characterization pattern different from said first characterization pattern that is printed directly opposite to said first characterization pattern.

21. The imaging apparatus of claim 20, wherein each of said first characterization pattern and said second characterization pattern has a plurality of regions, said plurality of regions including at least a first region having a first reflectivity and a second region having a second reflectivity different from said first reflectivity.

22. The imaging apparatus of claim 20, wherein said second characterization pattern has a show-through contribution that intersects said first characterization pattern.

23. The imaging apparatus of claim 22, wherein said first characterization pattern has a first plurality of regions and said second characterization pattern has a second plurality of regions, and wherein each said first information and said second information relates to reflectivity of said first image and associated show-through contribution at each intersection of the show-through contribution of said second plurality of regions of said second image with said first plurality of regions of said first image.

24. The imaging apparatus of claim 23, wherein said second characterization pattern includes a white region forming a white show-through contribution for said first plurality of regions of said first image and at least one non-white region forming a corresponding at least one non-white show-through contribution for said first plurality of regions of said first image.

* * * * *

UNITED STATES PATENT AND TRADEMARK OFFICE

CERTIFICATE OF CORRECTION

PATENT NO. : 7,620,359 B2
APPLICATION NO. : 11/133524
DATED : November 17, 2009
INVENTOR(S) : Gardner et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1216 days.

Signed and Sealed this

Twenty-sixth Day of October, 2010

David J. Kappos

David J. Kappos
*Director of the United States Patent and Trademark Office*